US007591329B2

(12) United States Patent
Perpezat et al.

(10) Patent No.: US 7,591,329 B2
(45) Date of Patent: Sep. 22, 2009

(54) AUGER WITH A MOVABLE GOUGE FOR MAKING A BOREHOLE

(75) Inventors: Daniel Perpezat, Nanterre (FR); Philippe Chagnot, Nanterre (FR); Régis Bernazinski, Nanterre (FR); Lewis Stansfield, Nanterre (FR)

(73) Assignee: Compagnie du Sol, Nanterre (FR)

( * ) Notice: Subject to any disclaimer, the term of this patent is extended or adjusted under 35 U.S.C. 154(b) by 131 days.

(21) Appl. No.: 11/493,706

(22) Filed: Jul. 27, 2006

(65) Prior Publication Data

US 2007/0023207 A1 Feb. 1, 2007

(30) Foreign Application Priority Data

Jul. 28, 2005 (FR) ..... 05 08057
Apr. 18, 2006 (GB) ..... 0607612.9

(51) Int. Cl.
*E21B 10/00* (2006.01)

(52) U.S. Cl. ..... 175/384; 175/323; 175/394; 175/263; 405/252.1

(58) Field of Classification Search ..... 175/323, 175/394, 384, 263; 405/252.1
See application file for complete search history.

(56) References Cited

U.S. PATENT DOCUMENTS 4,193,462 A 3/1980 Blaschke et al.
5,507,357 A * 4/1996 Hult et al. ..... 175/385

FOREIGN PATENT DOCUMENTS

| | | | |
|---|---|---|---|
| EP | 1 471 186 | A1 | 10/2004 |
| EP | 1 471 187 | A1 | 10/2004 |
| GB | 2 183 703 | A | 6/1987 |
| GB | 2 316 700 | A | 3/1998 |
| JP | 06-212873 | * | 8/1994 |
| WO | WO 94/02687 | | 2/1994 |

OTHER PUBLICATIONS

Patent Abstracts of Japan, vol. 014, No. 81, Feb. 15, 1990 & JP 01 295913 a (Tousen Asano Paul KK; others, Nov. 29, 1989.

* cited by examiner

*Primary Examiner*—Jennifer H Gay
*Assistant Examiner*—Sean D Andrish
(74) *Attorney, Agent, or Firm*—Kenyon & Kenyon LLP

(57) ABSTRACT

The invention relates to an auger for making a borehole that presents in its inside wall a groove that is substantially helical, said auger comprising: a hollow core provided with an outer helical blade; a movable cutter gouge suitable for taking up an active position in which the gouge projects outside the volume defined by the periphery of the blade, and a retracted position in which it is placed inside said volume; and means for displacing said gouge from its retracted position to its active position and comprising an additional member mounted to move in said core in translation and/or in rotation, and placed at the bottom end of said core, together with control means for causing said gouge to be displaced from its retracted position to its active position in response to said additional member moving relative to at least the bottom portion of said hollow core.

33 Claims, 10 Drawing Sheets

AUGER WITH A MOVABLE GOUGE FOR MAKING A BOREHOLE

BACKGROUND OF THE INVENTION

For making a bored pile or a cast-in-place pile, it is usual to make use of a tool such as an auger that serves to dig a cylindrical excavation in the ground corresponding to the dimensions of the pile that is to be made, and that also serves to raise the excavated material. Often, the auger is fitted with a dip tube that is mounted to slide in the hollow core of the auger and that serves, while the auger is being raised, to inject progressively into the borehole the concrete or grout that is to form the pile.

The forces that can be absorbed by a bored or cast-in-place pile depend firstly on its diameter and secondly on the coefficient of friction that exists between the outer wall of the pile and the inside wall of the borehole.

Increasing the diameter of the pile leads to an increase in the cost of boring and above all to an increase of the quantity of grout or concrete that needs to be used to make the pile. It can thus be understood that in order to increase the effectiveness of the pile it is advantageous to increase the coefficient of friction between the pile and the ground. To do this, it is known to use a gouge to form a helical groove in the inside wall of the borehole, and subsequently, like the remainder of the borehole, the groove will be filled with the concrete or the grout so as to form a helical rib penetrating into the ground.

This is shown in accompanying FIG. 1, where reference 10 designates the cylindrical borehole, reference 12 the inside wall of the borehole, and reference 14 the helical groove formed in the wall 12 of the borehole. In this figure, there can also be seen the pile 16 with its helical rib 18 penetrating into the ground S.

To make the helical groove in the wall of the borehole, it is common practice to fit the bottom end of the blade or "flight" of the auger with a tooth that is used as a gouge. In certain circumstances, the gouge is stationary, i.e. it forms a groove both when the auger is going down and when it is going up. That is described in European patent EP 1 277 877 in the name of Compagnie du Sol. In order to obtain high quality for this groove, i.e. effective compacting of the walls of the rib, it is necessary in particular to control accurately the speed of rotation and the linear displacement of the auger as it goes down, and above all as it comes back up.

To simplify those operations, proposals have been made to use an auger fitted with a retractable gouge that projects beyond the flight of the auger for the purpose of making the groove only while the auger is rising. In general, the movable gouge is caused to be extended merely by reversing the direction of rotation of the auger. One such solution is described in EP 1 471 187 in the name of Compagnie du Sol. Such a solution presents the advantage of being simple, but in some circumstances it presents the drawback of not being certain to extend the gouge for the purpose of making the helical groove.

OBJECTS AND SUMMARY OF THE INVENTION

An object of the present invention is to provide an auger fitted with a movable gouge in which it can be ensured that the gouge is extended effectively while the auger is rising in a manner that is reliable with the gouge being maintained in this position. According to the invention, in order to achieve this object, the auger comprises:

a core;

at least one helical blade mounted on the outside face of the core and extending over at least a substantial fraction of the length of the core;

a movable cutter gouge suitable for taking up an active position in which the gouge projects outside the volume defined by the periphery of the blade and a retracted position in which it is disposed inside said volume; and displacement means for displacing said gouge from its retracted position to its active position;

wherein:

said core of the auger is hollow; and said displacement means comprise:

an additional member mounted to move in said core in translation and/or in rotation and disposed at least at the bottom end of said core; and control means for causing said gouge to be displaced from its retracted position to its active position in response to said additional member moving relative to at least the bottom portion of said hollow core.

It will be understood that the movable gouge is moved from its retracted position to its active or extended position by the additional member moving in translation or rotation. Thus, while the auger is being raised, the gouge is extended into its active position in a manner that is very reliable.

In a first configuration, said additional member is a tubular element extending over the entire length of the core of the auger and having a top end connected to a pipe for feeding a slurry under pressure and whose bottom end is provided with at least one orifice for enabling the slurry to be injected into the borehole.

In a first embodiment, said tubular element is movable in translation in said core, and said control means cause the gouge to be displaced from its retracted position to its active position in response to the movement in translation of said tubular element.

In a second embodiment, said tubular element is movable in rotation in said core, and said control means cause the gouge to be displaced from its retraced position to its active position in response to said tubular element turning.

In this first configuration, said tubular element is a dip tube which is movable in translation in said hollow core between a retracted position in which the bottom end of the dip tube closes the bottom end of the core of the auger, and an extended position in which the bottom end of the dip tube projects from the bottom end of the auger.

In a second configuration, said additional member is a tube segment mounted to be movable in translation and/or in rotation in the hollow core of the auger, at its bottom end.

In a third embodiment, said tube segment is mounted to move in translation inside the core of the auger, and said control means cause the gouge to be displaced from its retracted position to its active position in response to the displacement of the tube segment.

In a fourth embodiment, said tube segment is movable in rotation inside the core of the auger, and said control means cause the gouge to be displaced from its retracted position to its active position in response to the movement in rotation of said tube portion.

In a fifth embodiment, the core of said auger comprises a top portion and a bottom portion that is movable in translation relative to said top portion over a predetermined length, said gouge being mounted on said bottom portion, said additional member comprises a tubular part secured to the bottom end of the top portion of said core and penetrating inside said bottom portion of the hollow core, and said control means are mounted on said tubular part in such a manner that displacement of said bottom portion of the core in translation relative to said tubular part causes the gouge to be displaced from its retracted position to its active position.

BRIEF DESCRIPTION OF THE DRAWINGS

Other characteristics and advantages of the invention appear better on reading the following description of several embodiments of the invention given as non-limiting examples. The description refers to the accompanying figures, in which.

MORE DETAILED DESCRIPTION

Figure 1:
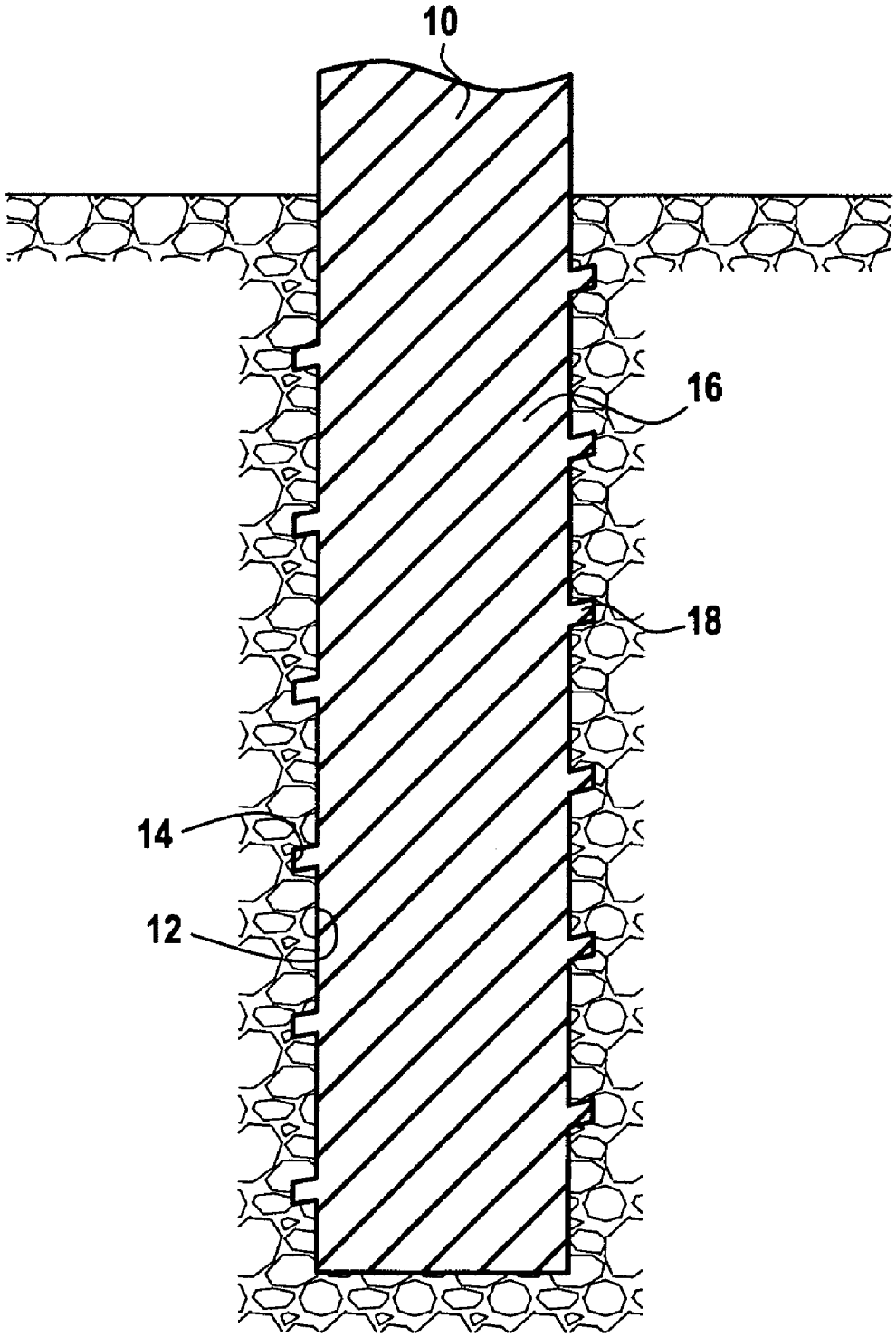
FIG. 1, described above, is a vertical section through a bored pile obtained using an auger with a gouge.
Figure 2:
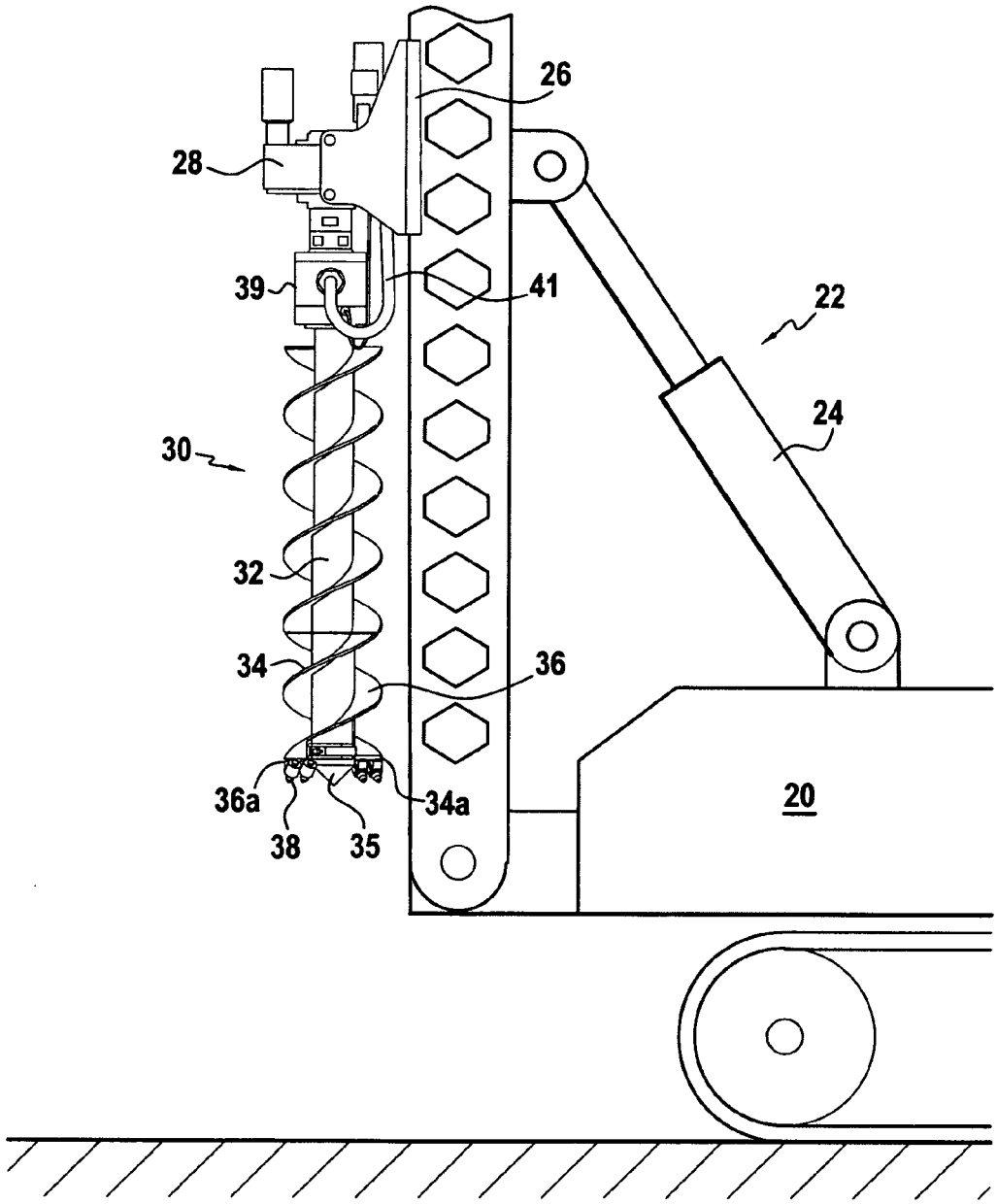
FIG. 2 is an elevation view of a boring machine assembly including an auger with a movable gouge.

With reference initially to FIG. 2, there follows a description of the boring machine assembly including the gouge-carrying auger. In this figure, there can be seen a platform 20 with a hinged guide mast 22 with control means symbolized by actuators 24. A carriage 26 can move along the guide mast 22, the carriage carrying a drive head 28 for setting the auger 30 into rotation. The carriage 26 can be moved along the mast 22 by means that are not shown. It is thus possible to control both the speed of rotation of the auger using the rotary drive head 28 and also to control the linear displacement speed of the auger by controlling the displacement of the carriage 26 relative the mast 22.

The auger 30 is constituted by a hollow cylindrical core 32 and by two helical blades or "flights" 34 and 36 that are angularly offset by 180°. The core 32 is terminated by a pointed tip 35. The leading edges 34*a* and 36*a* of the flights are fitted with teeth such as 38.

Naturally, it would not go beyond the invention for the auger to have a single helical flight or for the auger to have one helical flight extending along its entire height and a second helical flight extending over its end portion close to its tip 35.

In the description below with reference to FIGS. 3A to 10B, a first embodiment of the invention is described in which the additional member is a tubular part that extends over the entire length of the core of the auger, and that is preferably a dip tube.

Dip-tube-fitted augers are boring machines that are well known and that are described in particular in French patent application No. 2 807 455 in the name of the Applicant, which should be considered as forming an integral portion of the present description. Under such circumstances, the auger has a hollow core in which a "dip" tube can move in translation, the top end of the dip tube being connected by a hose to a source of grout or cement or more generally a slurry, and the bottom end can project from the bottom end of the auger to allow the grout or the concrete to be injected through orifices into the borehole made using the auger. The dip tube can be moved in translation relative to the auger, e.g. with the help of actuators mounted on the rotary drive head of the auger, and as a general rule the dip tube can also be moved in rotation about its longitudinal axis relative to the auger.

In the first embodiment of the invention, the drive means of the movable gouge are controlled by the dip tube moving in translation relative to the auger.

Figure 3A:
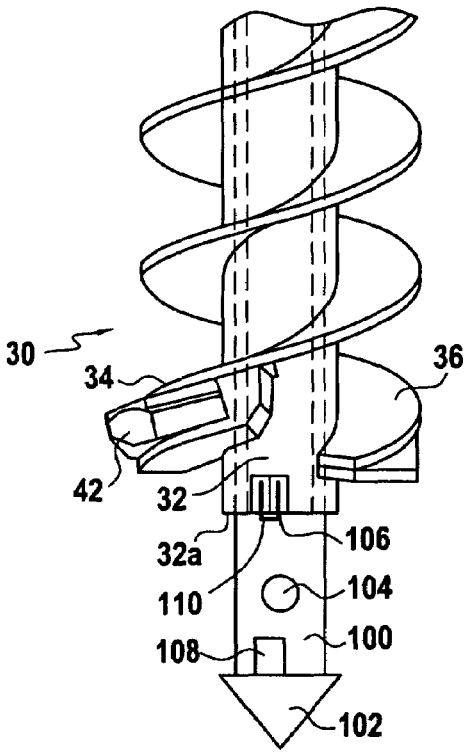
FIGS. 3A and 3B show the bottom end of an auger fitted with a dip tube corresponding to a first embodiment of the invention.
Figure 3B:
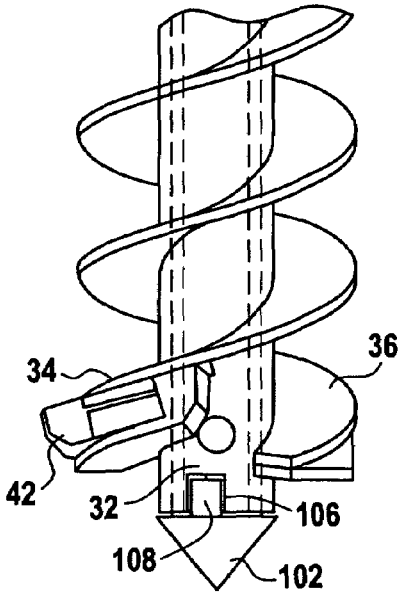
Figure 4:
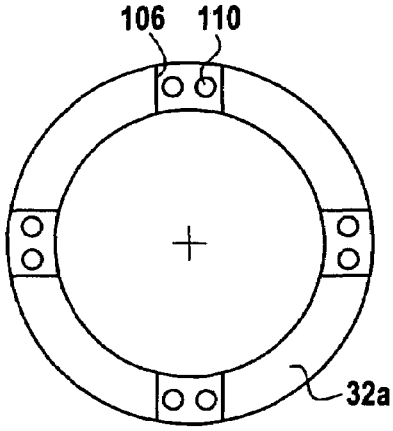
FIG. 4 is a view from beneath showing the bottom end of the core of the auger in the first embodiment of the invention.

FIGS. 3A and 3B shows the bottom portion of the auger 30 with its core 32, its flights 34 and 36, and its pivotally-mounted gouge 42. A dip tube 100 is slidably mounted in the hollow core 32 and the bottom end of the dip tube is closed by a conically-shaped tip 102. The dip tube has a plurality of orifices 104 to allow the grout or the cement to escape. When the dip tube 100 is in its raised position inside the core of the auger 32, the dip tube and the auger are constrained to rotate together. For this purpose, the bottom face 32*a* of the core 32 of the auger is provided with notches such as 106 suitable for co-operating with studs 108 provided at the periphery of the bottom end of the dip tube, i.e. immediately above its end 102. Thus, in the raised position, the auger and the dip tube are constrained to rotate together. In contrast, when the dip tube is in its extended position in order to allow concrete, cement, or grout to be injected, the bottom end of the dip tube 100 occupies a position such that the orifices 104 are disengaged, and naturally the studs 108 are moved out from the notches 106.

In this first embodiment shown in FIGS. 3A and 3B, moving pistons such as 110 are mounted in the notches 106. As can be seen more clearly in FIG. 4, the end 32*a* of the core of the auger may have four notches 106, each notch having two moving pistons 110 mounted therein.

It will be understood that when the dip tube is in its retracted position, as shown in FIG. 3B, the studs 108 penetrate into the notches 106 and push back the pistons 110. In contrast, when the dip tube is in its extended position, no action is exerted on a piston 110. It is this absence of action on the pistons 110 that is used for controlling the pivoting of the moving gouge 42.

Figure 5:
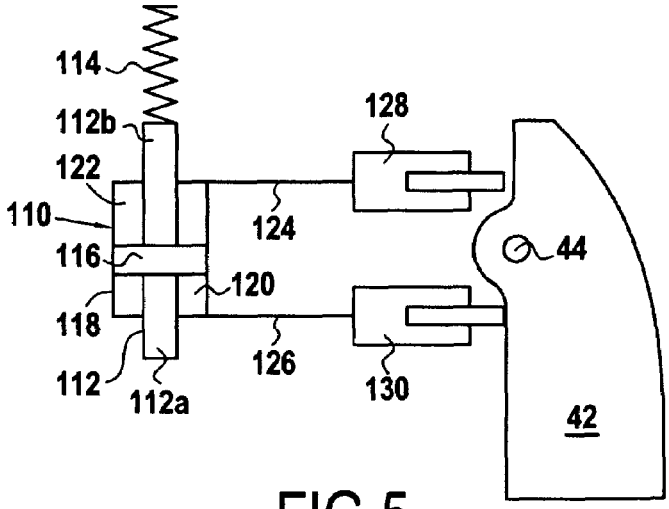
FIG. 5 shows the control circuit for controlling the movable gouge in the first embodiment of the invention.

As shown better in FIG. 5, each piston 110 is constituted by a rod 112 suitable for receiving drive from the studs 108 via a first end 112, while its second end 112*b* co-operates with a return spring 114. The rod 112 is associated with a piston 116 mounted to move in a cylindrical enclosure 118 filled with an incompressible liquid. The piston 116 subdivides the cylinder 118 into two respective chambers 120 and 122. Each chamber is connected by a duct 124, 126 to a respective control actuator 128, 130. The control actuators 128 and 130 act on the opposite sides of a pivot axis 44 of the gouge 42 so as to bring said gouge respectively into its extended position or into its retracted position.

It will be understood that when the dip tube is in its retracted position (FIG. 3B), the studs 108 act on the end 112A of the rod 112, thus firstly compressing the return spring 114 and secondly feeding incompressible liquid to the actuator 128, thereby bringing the gouge 42 into its retracted position. In contrast, when the dip tube is caused to be extended relative to the auger (FIG. 3A), the studs cease to act on the end 112A of the rod 112, which is then driven by the return spring 114 so as to expel the incompressible liquid from the chamber 120 towards the actuator 130, thereby bringing the gouge 42 into its extended position, with the gouge being held in this position by the return spring 114.

Figure 6:
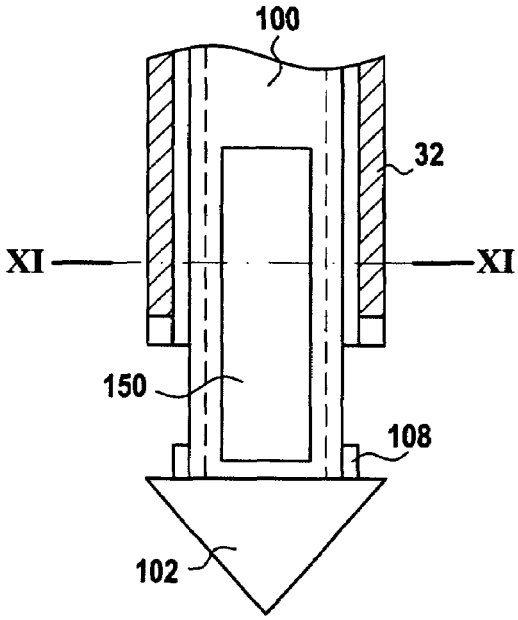
FIG. 6 shows the bottom end of the auger in a second embodiment of the invention.
Figure 7:
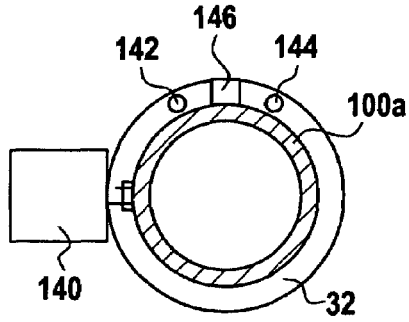
FIG. 7 is a simplified plan view of the FIG. 6 auger.

FIGS. 6, 7, and 8 show a second embodiment of the invention. In this embodiment, use is made of rotary movement of the dip tube relative to the auger for the purpose of controlling the movable gouge drive means. At the rotary drive head of the auger 30, an additional motor 140 is provided, that enables rotary drive to be imparted to the dip tube 100 relative to the core 32 of the auger. More precisely, this capacity for rotation is limited by two abutments 142 and 144 formed at the top end of the core 32 of the auger and by an extension 146 secured to the outside face at the top end 100*a* of the dip tube. By turning about its longitudinal axis, the dip tube 100 can be brought into a first position in which the extension 146 is in contact with the abutment 142, or into a second position in which the extension 146 is in contact with the second abutment 144.

Figure 8A:
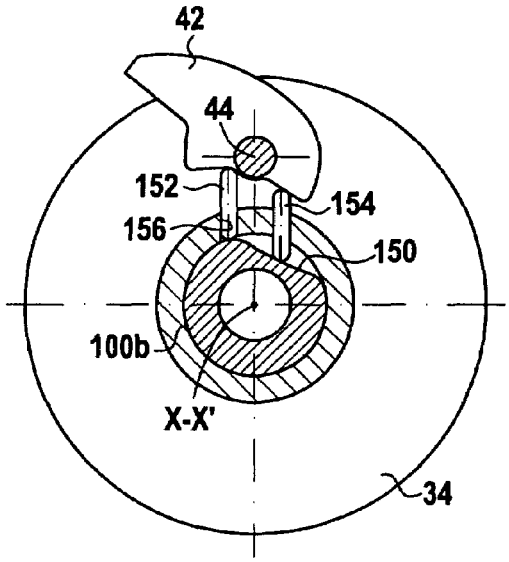
FIGS. 8A and 8B are section views on line XI-XI of FIG. 6 showing the gouge in its "extended" position and in its "retracted" position.
Figure 8B:
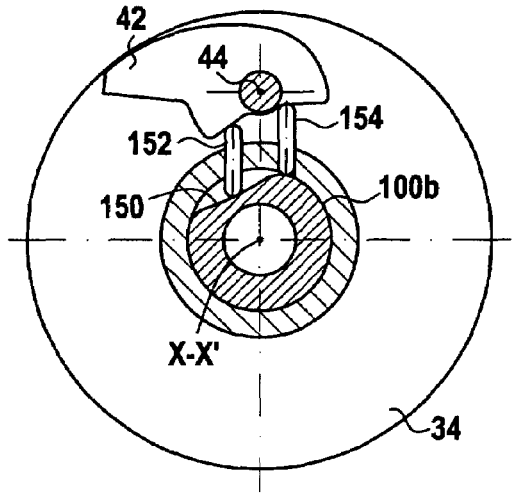

As shown more clearly in FIG. 6, in the vicinity of its bottom end, the dip tube 100 has a portion 150 set back from its outside wall 100*b*, which portion is also visible in FIGS. 8A and 8B. This set-back portion 150 constitutes a cam that can be turned about the longitudinal axis X-X' of the dip tube and of the core 32 of the auger. Two pushers 152 and 154 are mounted level with the movable gouge 42, the pushers being movable in translation in holes 156 and 158 formed through the core 32 of the auger. The first ends of the pushers are in contact with the outside face of the dip tube 100 while their other ends are in contact with the control portion of the movable gouge on either side of its pivot axis 44.

In the first angular position of the dip tube 100, the pusher 152 is in contact with the outside wall 100*b* of the dip tube, while the pusher 154 is in contact with the setback 150, thus bringing the movable gouge 42 into the extended position (FIG. 8A). In contrast, in the second angular position, it is the first pusher 152 that is in contact with the setback 150, while the second pusher 154 is in contact with the outside wall 100*b* of the dip tube 100. This holds the gouge 42 in its retracted position.

Figure 9:
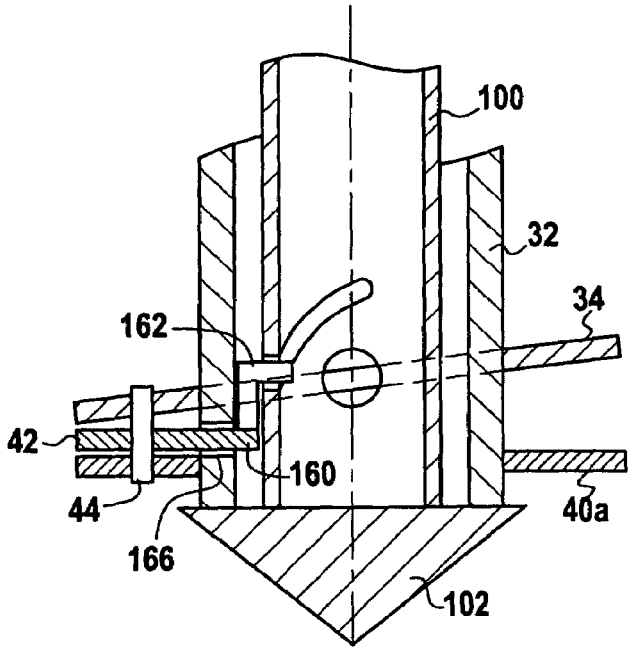
FIG. 9 is a vertical section view of the bottom end of the auger in a variant of the first embodiment of the invention.
Figure 10A:
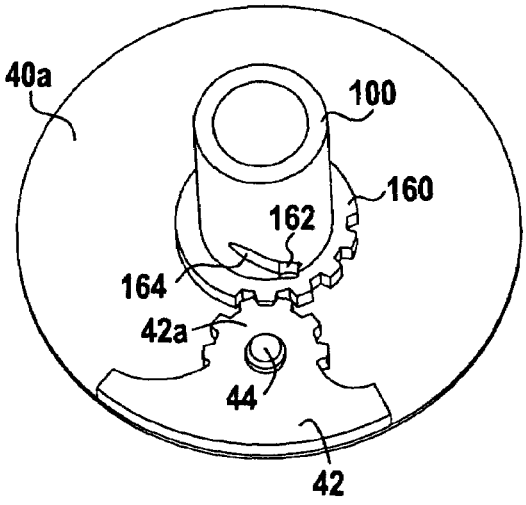
FIGS. 10A and 10B are fragmentary perspective views of the bottom portion of the FIG. 9 auger showing the movable gouge in its two positions.
Figure 10B:
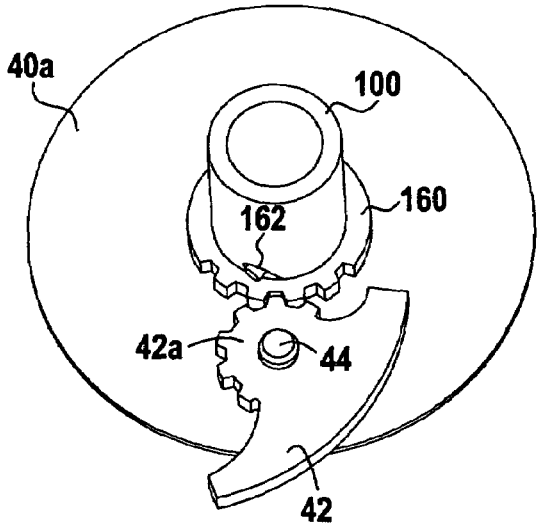

With reference now to FIGS. 9, 10A, and 10B, there follows a description of a variant of the first embodiment of the invention.

To control the displacements of the movable gouge 42, use is made of the movement in vertical translation of the dip tube 100 relative to the core of the auger 32. The control member is constituted essentially by a ring 160 with teeth occupying part of its circumference. The ring surrounds the tip tube 100 is and is free to rotate relative thereto, but is prevented from moving in vertical translation relative to the dip tube. The ring 160 is secured to a control finger 162 which penetrates into a helical slot 164 formed in the corresponding portion of the dip tube and constituting a cam. In reality, in order to take account of the length of the stroke of the dip tube relative to the core of the auger, the helical slot formed in the dip tube is preceded by a vertical slot which therefore has no effect on the ring. The toothed portion of the rotary ring 162 co-operates with a control portion 42*a* of the movable groove 42, which control portion is likewise toothed. The meshing between the toothed portion of the ring 162 and the control portion 42*a* of the gouge 42 takes place through a slot 166 formed in the bottom portion of the hollow core 32 of the auger.

It will be understood that when the dip tube 100 is moved in the vertical direction relative to the core of the auger, the helical slot 164 acts as a cam causing the control finger 162 to turn in one direction or the other and thus turning the partially-toothed ring 162. When the ring turns it drives the movable gouge 42 to turn about its own axis 42 so as to bring it either into the retraced position as shown in FIG. 10A or into the extended position as shown in FIG. 10B.

As in the first embodiment, a rotation sensor can be mounted on the pivot axis 44 of the gouge 42. The signal delivered by the sensor is conveyed to the control assembly of the auger and serves to verify that the gouge 42 does indeed occupy the desired position.

Nevertheless, in these two embodiments, it is preferable to use the displacement (in rotation or in translation) of the dip tube relative to the core of the auger to detect whether the gouge 42 has indeed been brought into its extended position. These movements are easily detected at the top end of the auger.

Figure 11A:
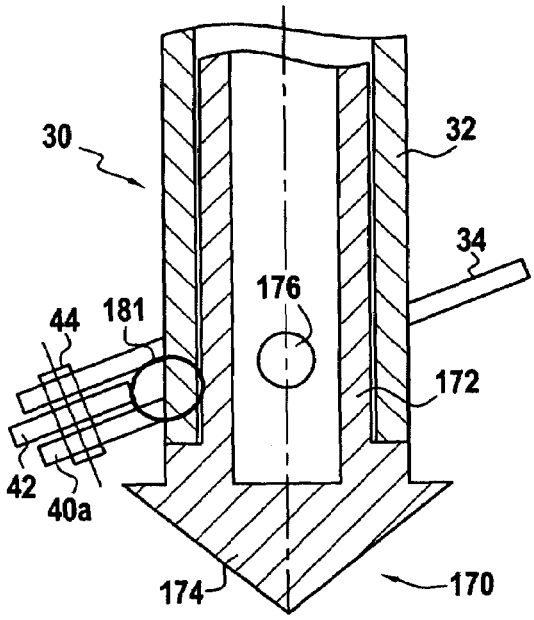
FIGS. 11A and 11B show the bottom end of the auger in a third embodiment of the invention.
Figure 11B:
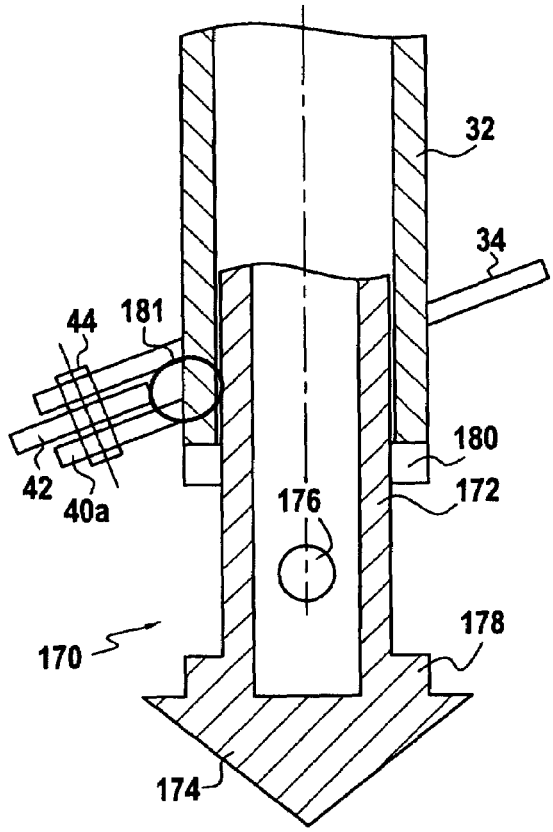

With reference to FIGS. 11A and 11B there follows a description of a third embodiment of the invention. It corresponds to the auger 30 not being fitted with a tubular element extending along the entire length of the core of the auger. The grout or concrete is then injected into the borehole by feeding the hollow core 32 of the auger therewith.

In this embodiment, the bottom end of the auger is fitted with a movable part 170 constituted by a segment of tube 172 of length that is short relative to the length of the auger and closed at its bottom end by an end wall 174 of conical shape forming the pointed tip of the auger. The tube segment 172 is free to move in translation in the hollow core of the auger and is provided with orifices 176 through which the grout or concrete exits. In addition, when the movable part 170 is in the retracted position inside the auger, the movable part is constrained to rotate together therewith by studs 178 and notches 180 formed in the bottom edge of the core 32 of the auger.

During downward movement of the auger, corresponding to digging the borehole, the movable part 170 is held retracted inside the core of the auger (FIG. 11A). In contrast, when the auger is raised and a grout or concrete is injected into its hollow core, the pressure of the material on the movable part 170 and also the action of the surrounding ground causes the movable part 170 to move in translation relative to the core of the auger, with the amplitude of this relative movement being limited, for example, by abutments (not shown in the figures). This is shown in FIG. 11B.

This result can also be obtained by interposing a spring between the core of the auger and the movable part. While the auger is moving downwards, the spring is compressed. When the upward movement is started, the spring can expand and cause the movable part to be extended.

This relative movement in translation serves to control the pivoting of the gouge 42 via drive means that are represented symbolically by reference 181.

The control means may be of the type shown in FIGS. 6 to 8 (hydraulic) or of the type shown in FIGS. 9 and 10 (mechanical), with the tube segment 172 of the movable part replacing the dip tube.

Figure 12:
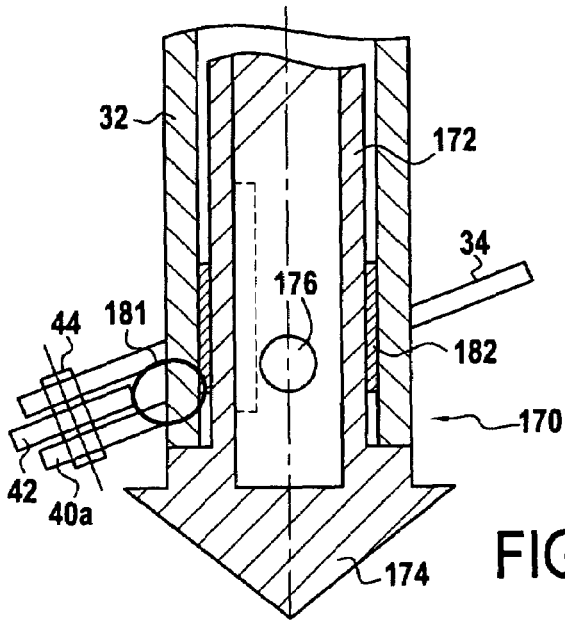
FIG. 12 shows the bottom end of the auger in a fourth embodiment of the invention.

FIG. 12 shows a fourth embodiment of the invention.

In this embodiment, the auger 30 is fitted with a movable part 170 that is mounted to slide in the hollow 32 of the auger. The difference relative to the third embodiment consists in the fact that the outside face of the tube portion 172 and the bottom end of the inside face of the hollow core 32 of the auger has complementary portions in relief 182 suitable for converting the movement in translation of the movable part 170 relative to the core of the auger when the auger rises, into a movement in rotation. It is this movement that is used to control the displacement of the gouge 42.

The control means represented by reference 184 may then be of the type shown in FIGS. 6 and 8, with the tube segment 172 replacing the dip tube.

In the embodiment described with reference to FIGS. 3 to 12, the movable gouge is caused to turn in order to go from its retracted position to its extended or active position. It will nevertheless be understood that by making modifications within the competence of the person skilled in the art, the control means could be arranged so that the movable gouge is caused to move in translation in a direction that is radial relative to the axis of the core of the auger.

With reference below to FIGS. 13 to 23, there follows a description of a fifth embodiment of the invention.

In this embodiment, the auger is constituted by a cutter head 220 mounted at the bottom end of a string of hollow rods, these rods being provided with respective external helical blades or "flights". The description below relates essentially to the cutter head 220 that serves to cause the gouge 240 to move. As explained below, the gouge is moved in translation along a radial direction that is substantially orthogonal to the longitudinal axis of the cutter head 220. Nevertheless, it will readily be understood that by a simple modification within the competence of the person skilled in the art, this movement could be a pivoting movement about an axis associated with the cutter head.

The cutter head 220 comprises an top portion 222 and a bottom portion 224. The top end 222*a* of the cutter head is connected to a string of flight rods by connection means 226. The bottom end 222*b* of the top portion is extended downwards by a tubular extension 228. The top portion 222 is constituted by a cylindrical body 230 and a flight 232.

The bottom portion 224 is generally in the form of a cylindrical hollow rod 234 provided with a flight 236. The extension 228 of the bottom portion 222 is slidably mounted in the hollow rod 224 of the bottom portion 224.

The bottom portion 224 is connected to the top portion 222 by connection means 238. The connection means 238 constrain the portions 222 and 224 in rotation while allowing the portions 222 and 224 to perform relative movement in translation over a limited amplitude.

The bottom end 224*a* of the bottom portion 224 is provided with a movable gouge (or cutter tooth) 240. The gouge 240 is connected to displacement means 242 for displacing the gouge.

The bottom end 228*a* of the tubular extension 228 is provided with control means 244.

The control means 244 co-operate with the displacement means 242.

Figure 13:
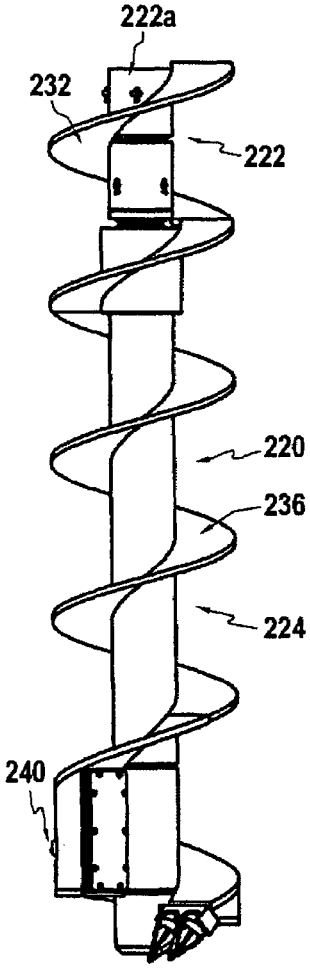
FIG. 13 is an elevation view of a fifth embodiment of the invention.
Figure 14:
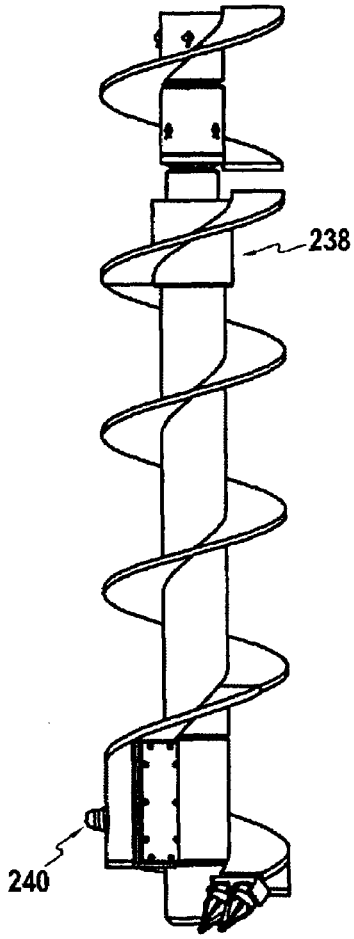
FIG. 14 is a side view of the fifth embodiment of the invention.
Figure 15:
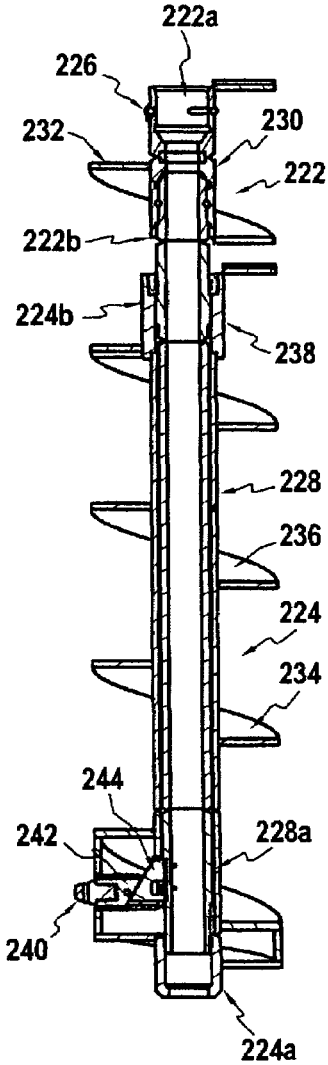
FIG. 15 is a vertical section view of the fifth embodiment of the invention.
Figure 16:
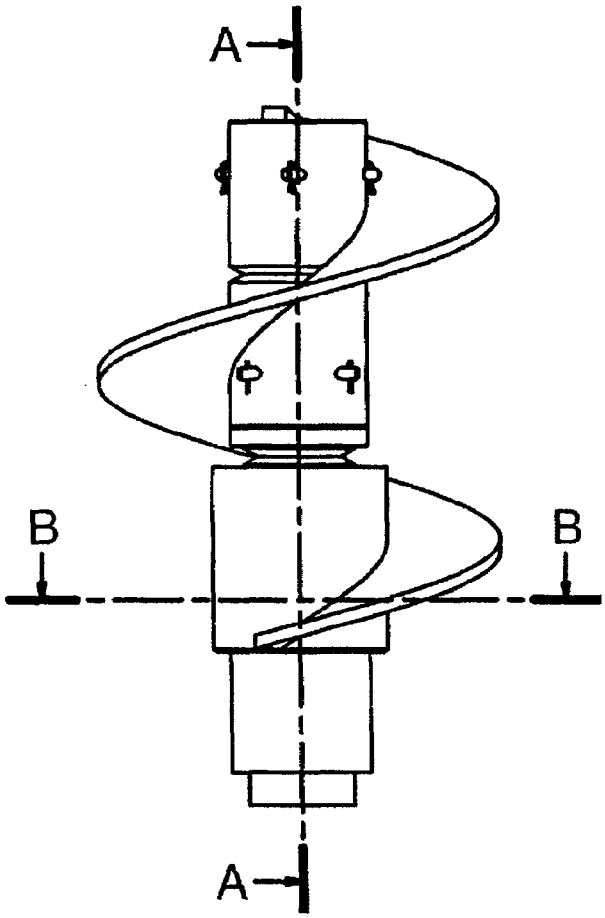
FIG. 16 is an elevation view of the top portion of the cutter head in the retracted position in a fifth embodiment of the invention.
Figure 17:
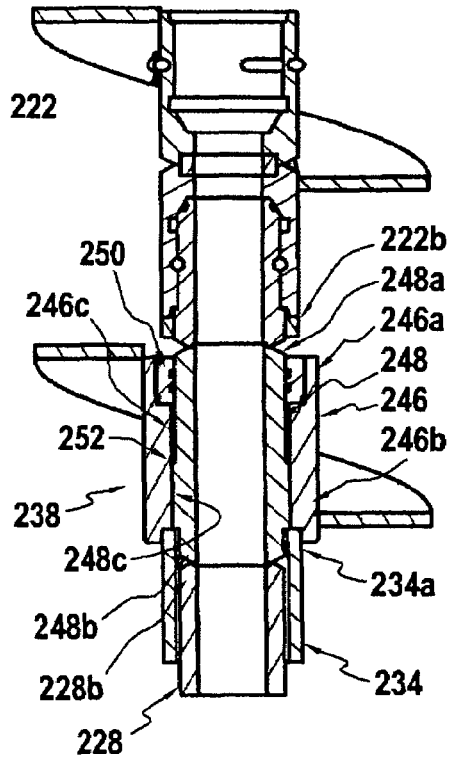
FIG. 17 is a vertical section view on line A-A of FIG. 16.
Figure 18:
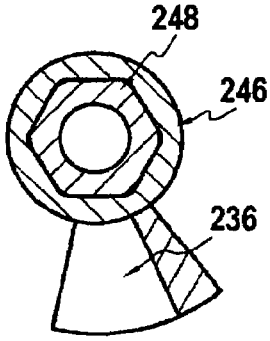
FIG. 18 is a horizontal section view on line B-B of FIG. 16.
Figure 19:
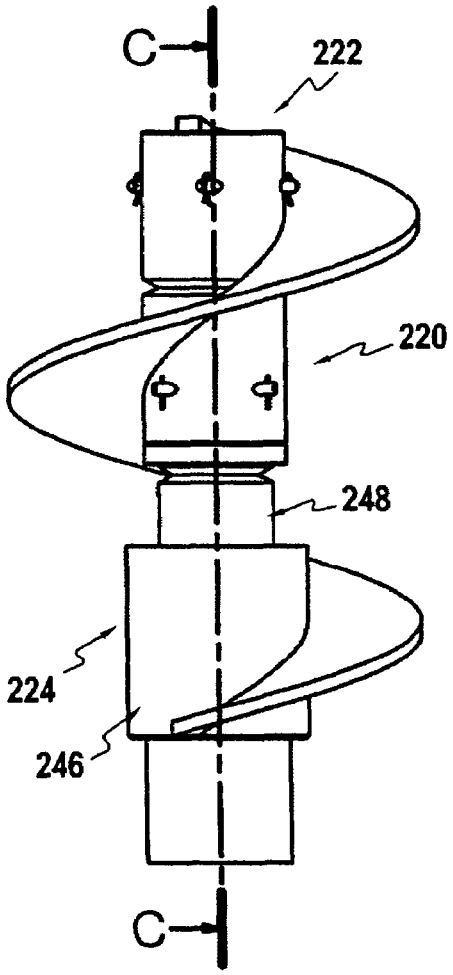
FIG. 19 is a view similar to that of FIG. 16, the cutter head being in its extended position.
Figure 20:
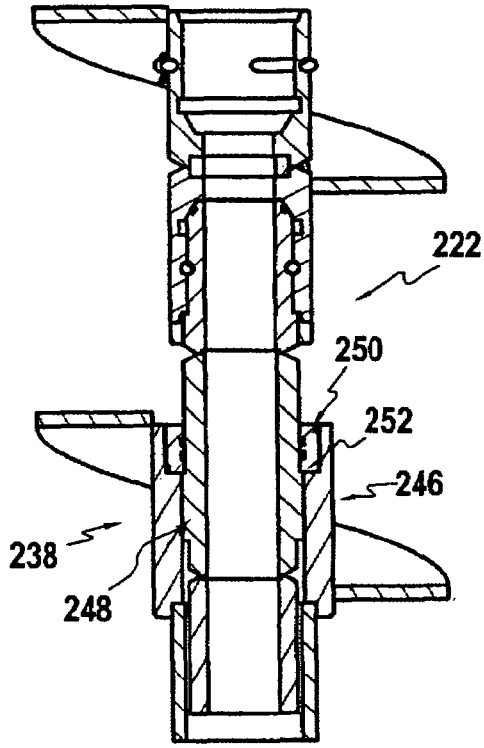
FIG. 20 is a vertical section view on line C-C of FIG. 19.

As explained in greater detail below, when the top portion 222 bears against the top end 224*b* of the bottom portion, the gouge 240 is in its retracted position as shown in FIG. 13. This corresponds to the auger moving downwards. When the top portion 222 and the bottom portion 224 are spaced apart, as shown in FIG. 14, then the control means 244 act on the displacement means 242 to move the gouge 240 into its extended position and to hold it there. This corresponds to the auger being moved upwards.

With reference below to FIGS. 16 to 20, there follows a description of a preferred embodiment of the connection means 238.

As shown in FIGS. 16 to 20, the top end 234*a* of the hollow rod 234 is secured to a hexagonal female connection box 246. The bottom end 222*b* of the top portion 222 is secured to the top portion 248*a* of a hexagonal male drive member 248. The bottom end 248*b* of the male member 248 is secured to the top end 228*b* of the extension 228. The male and female members 246 are constrained to rotate together.

The top end 246*a* of the female member is provided with a retaining ring 250 secured to the female drive box 246 and projects out from the inside wall 246*c* of the drive box 246. The outer wall 248*c* of the male member 248 is provided with a shoulder 252 that co-operates with the retaining ring 250.

When the top portion 222 is spaced apart from the bottom portion 224, the amplitude of the displacement is limited by co-operation between the ring 250 and the shoulder 252.

Figure 21:
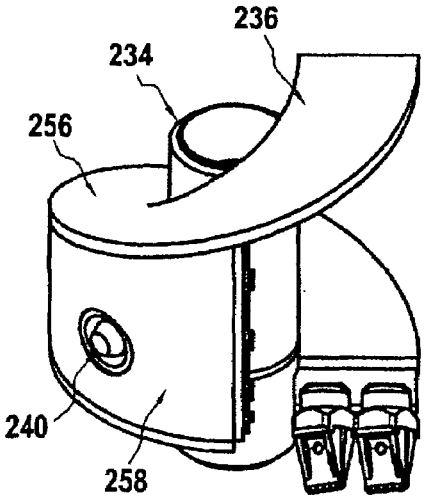
FIG. 21 is a perspective view of the bottom portion of the cutter head.
Figure 22:
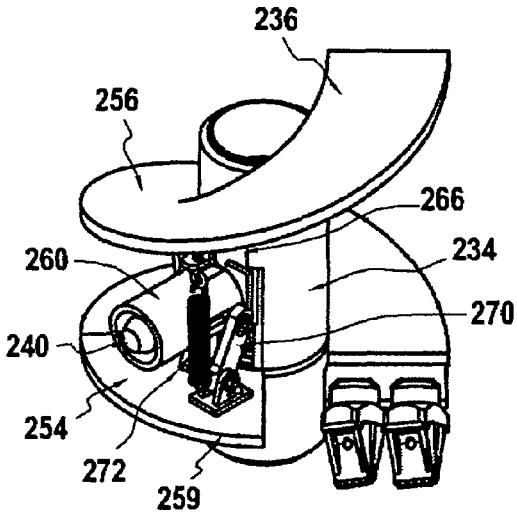
FIG. 22 is a view analogous to FIG. 21, but partially cut away.
Figure 23:
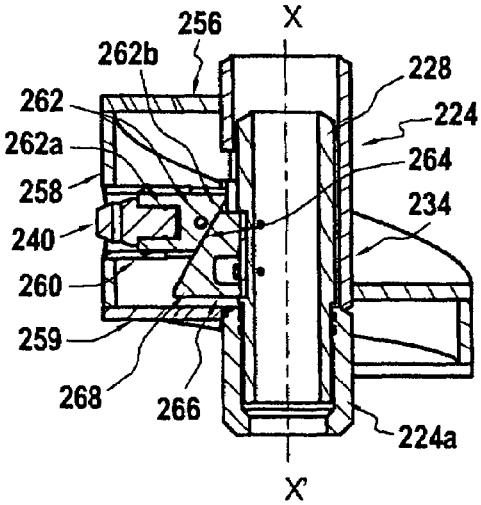
FIG. 23 is a vertical section view of the bottom end of the cutter head.

With reference below to FIGS. 21 to 23, there follows a description of a preferred embodiment of the control and displacement means 242, 244.

Close to the bottom end 224*a* of the bottom portion, a protected volume 254 is defined by the helix 256 of the flight, by a side wall 258, and by a bottom plate 259. In the volume 254, a horizontal-axis guide tube 260 is secured to the rod 234 of the bottom portion 224. The tube 260 extends radially. A piston 262 is mounted to slide in the tube. The gouge 240 is secured to a first end 262*a* of the piston. The second end of the piston is in the form of an inclined surface 264.

The bottom end of the rod 234 is provided with a slot 266 in which a wedge-shaped control member 268 can move vertically. The wedge 268 is secured on the bottom end of the extension 228. Vertical displacement of the extension 228 is converted into horizontal movement of the gouge 240 by co-operation between the surface 264 and the wedge 268. When the wedge 268 does not co-operate with the surface 264, a return system constituted by a lever 270 connected to the piston 262 and a return spring 272 causes the gouge 240 to be retracted.

The operation of this fifth embodiment of the invention is as follows:

When the cutter head 220 is moving downwards and in rotation to dig the borehole, the top portion 222 bears against the bottom portion 224. The extension 228 is in its low position in the rod 234 of the bottom portion 224, and the wedge 268 does not act on the inclined surface 264. The gouge 240 is held in its retracted position.

When the cutter head 220 is moving upwards, the top and bottom portions 222 and 224 are spaced apart from each other. The wedge 268 occupies a high position and acts on the inclined surface 264 of the piston 262. The gouge 240 is then taken to its extended position and it is held in this position so long as traction is exerted on the top portion 222 of the cutter head.

What is claimed is:

1. An auger for making a borehole that presents in an inside wall a groove that is substantially helical, said auger comprising:

a hollow cylindrical core having a longitudinal axis and a bottom portion;

at least one helical blade mounted on an outside face of the core and extending over at least a substantial fraction of a length of the core;

a movable cutter gouge suitable for taking up an active position in which the gouge projects outside a volume defined by a periphery of the blade and a retracted position in which the gouge is disposed inside said volume;

displacement means for displacing said gouge from said retracted position to said active position, comprising:

an additional hollow tubular member mounted to move in said core in translation along said longitudinal axis and disposed at least at a bottom end of said core; and control means for causing said gouge to be positively displaced from said retracted position to said active position in response to the translation of said additional hollow tubular member moving relative to at least the bottom portion of said hollow core; and a supply system to deliver grout or concrete through said hollow cylindrical core and said hollow tubular member, wherein the core of said auger comprises a top portion and the bottom portion that is movable in translation relative to said top portion over a predetermined length, said gouge being mounted on said bottom portion, wherein said additional member comprises a tubular part secured to the bottom end of the top portion of said core and penetrating inside said bottom portion of the hollow core, and wherein said control means are mounted on said tubular part in such a manner that displacement of said bottom portion of the core in translation relative to said tubular part causes the gouge to be displaced from said retracted position to said active position.

2. An auger according to claim 1, wherein said additional member is a tubular element extending over an entire length of the core of the auger and having a top end connected to a pipe for feeding a slurry under pressure and a bottom end is provided with at least one orifice for enabling the slurry to be injected into the borehole.

3. An auger according to claim 2, wherein said tubular element is movable in rotation in said core, and wherein said control means cause the gouge to be displaced from said retracted position and said active position in response to said tubular element turning.

4. An auger according to claim 2, wherein said tubular element is a dip tube which is movable in translation in said hollow core between a retracted position in which the bottom end of the dip tube closes the bottom end of the core of the auger, and an extended position in which the bottom end of the dip tube projects from the bottom end of the auger.

5. An auger according to claim 4, wherein said gouge is mounted to pivot about an axis substantially parallel to the longitudinal axis of the core, and wherein the dip tube is movable in rotation and the control means comprise a set-back portion formed in an outside face of the dip tube over a fraction of a periphery of said dip tube, and two pushers slidably mounted in the core of the auger, each pusher having a first end in contact with the outside face of the dip tube or the movable part, and a second end in contact with said movable gouge, whereby the dip tube turning relative to the core of the auger causes said pushers to be displaced so as to cause the movable gouge to pivot in one direction or another.

6. An auger according to claim 1, wherein said additional hollow tubular member is a tube segment mounted to move in translation in the hollow core of the auger, at the bottom end of said hollow core.

7. An auger according to claim 6, wherein said tube segment is mounted to move in translation inside the core of the auger, and wherein said control means cause the gouge to be displaced from said retracted position to said active position in response to the displacement of the tube segment.

8. An auger according to claim 7, wherein said gouge is mounted to pivot about an axis substantially parallel to the axis of the core, and wherein the control means comprise a ring mounted to turn about the tube segment and to prevent the tube segment from moving in translation relative to the core of the auger, said ring being secured to a control finger suitable for co-operating with a helical slot formed in said movable tube segment whereby movement in translation of the tube segment is converted into movement in rotation of said ring, said ring including at least a portion that is toothed, suitable for co-operating with a toothed portion of the movable gouge.

9. An auger according to claim 7, wherein said gouge is mounted to pivot about an axis substantially parallel to the longitudinal axis of the core, and wherein the control means comprise a set-back portion formed in an outside face of the tube segment over a fraction of the periphery of the tube segment, and two pushers slidably mounted in the core of the auger, each pusher having a first end in contact with the outer face of the tube segment and a second end in contact with said movable gouge, whereby the tube segment turning relative to the core of the auger causes said pushers to be displaced so as to cause the movable gouge to pivot in one direction or the other.

10. An auger according to claim 1, further including means for constraining said top and bottom portions of the core relative to each other in rotation.

11. An auger according to claim 10, wherein said gouge is movable in translation along a radial direction.

12. An auger for making a borehole that presents in an inside wall a groove that is substantially helical, said auger comprising:

a hollow cylindrical core having a longitudinal axis and a bottom portion;

at least one helical blade mounted on an outside face of the core and extending over at least a substantial fraction of a length of the core;

a movable cutter gouge suitable for taking up an active position in which the gouge projects outside a volume defined by a periphery of the blade and a retracted position in which the gouge is disposed inside said volume; and displacement means for displacing said gouge from said retracted position to said active position;

an additional hollow tubular member mounted to move in said core in translation along said longitudinal axis and disposed at least at a bottom end of said core; and control means for causing said gouge to be positively displaced from said retracted position to said active position in response to the translation of said additional hollow tubular member moving relative to at least the bottom portion of said hollow core.

13. An auger according to claim 12, wherein said additional hollow tubular member is a tubular element extending over an entire length of the core of the auger and having a top end connected to a pipe for feeding a slurry under pressure and a bottom end is provided with at least one orifice for enabling the slurry to be injected into the borehole.

14. An auger according to claim 13, wherein said tubular element is a dip tube which is movable in translation in said hollow core between a retracted position in which the bottom end of the dip tube closes the bottom end of the core of the auger, and an extended position in which the bottom end of the dip tube projects from the bottom end of the auger.

15. An auger according to claim 14, wherein said gouge is mounted to pivot about an axis substantially parallel to the longitudinal axis of the core, and wherein the control means comprise a ring mounted to turn about the dip tube and is prevented from moving in translation relative to the core of the auger, said ring being secured to a control finger suitable for co-operating with a helical slot formed in the dip tube or a movable part, whereby movement in translation of the dip tube or said movable part is converted into movement in rotation of said ring, said ring including at least a portion that is toothed and suitable for co-operating with a toothed portion of the movable gouge.

16. An auger according to claim 12, wherein said additional hollow tubular member is a tube segment mounted to move in translation in the hollow core of the auger, at the bottom end of said hollow core.

17. An auger according to claim 16, wherein said tube segment is mounted to move in translation inside the core of the auger, and wherein said control means cause the gouge to be displaced from said retracted position to said active position in response to the displacement of the tube segment.

18. An auger according to claim 17, wherein said gouge is mounted to pivot about an axis substantially parallel to the longitudinal axis of the core, and wherein the control means comprise a ring mounted to turn about the tube segment and prevent the tube segment from moving in translation relative to the core of the auger, said ring being secured to a control finger suitable for co-operating with a helical slot formed in said movable tube segment whereby movement in translation of the tube segment is converted into movement in rotation of said ring, said ring including at least a portion that is toothed, suitable for co-operating with a toothed portion of the movable gouge.

19. An auger according to claim 16, wherein said gouge is mounted to pivot about an axis substantially parallel to the longitudinal axis of the core, and wherein the control means comprise a set-back portion formed in an outside face of the tube segment over a fraction of a periphery of the tube segment, and two pushers slidably mounted in the core of the auger, each pusher having a first end in contact with the outer face of the tube segment and a second end in contact with said movable gouge, whereby the tube segment turning relative to the core of the auger causes said pushers to be displaced so as to cause the movable gouge to pivot in one direction or another.

20. An auger according to claim 12, wherein the core of said auger comprises a top portion and the bottom portion that is movable in translation relative to said top portion over a predetermined length, said gouge being mounted on said bottom portion, wherein said additional hollow tubular member comprises a tubular part secured to the bottom end of the top portion of said core and penetrating inside said bottom portion of the hollow core, and wherein said control means are mounted on said tubular part in such a manner that displacement of said bottom portion of the core in translation relative to said tubular part causes the gouge to be displaced from said retracted position to said active position.

21. An auger according to claim 20, further including means for constraining said top and bottom portions of the core relative to each other in rotation.

22. An auger according to claim 21, wherein said gouge is movable in translation along a radial direction.

23. An auger for making a borehole that presents in an inside wall a groove that is substantially helical, said auger comprising:

a hollow cylindrical core having a longitudinal axis and a bottom portion;

at least one helical blade mounted on an outside face of the core and extending over at least a substantial fraction of a length of the core;

a movable cutter gouge suitable for taking up an active position in which the gouge projects outside a volume defined by a periphery of the blade and a retracted position in which the gouge is disposed inside said volume;

displacement means for displacing said gouge from said retracted position to said active position, comprising:

an additional hollow tubular member mounted to move in said core in translation along said longitudinal axis and disposed at least at the bottom end of said core; and control means for causing said gouge to be positively displaced from said retracted position to said active position in response to the translation of said additional hollow tubular member moving relative to at least the bottom portion of said hollow core; and a supply system to deliver grout or concrete through said hollow cylindrical core and said hollow tubular member.

24. An auger according to claim 23, wherein said additional member is a tubular element extending over an entire length of the core of the auger and having a top end connected to a pipe for feeding a slurry under pressure and a bottom end is provided with at least one orifice for enabling the slurry to be injected into the borehole.

25. An auger according to claim 24, wherein said tubular element is a dip tube which is movable in translation in said hollow core between a retracted position in which the bottom end of the dip tube closes the bottom end of the core of the auger, and an extended position in which the bottom end of the dip tube projects from the bottom end of the auger.

26. An auger according to claim 25, wherein said gouge is mounted to pivot about an axis substantially parallel to the longitudinal axis of the core, and wherein the control means comprise a ring mounted to turn about the dip tube and prevented from moving in translation relative to the core of the auger, said ring being secured to a control finger suitable for co-operating with a helical slot formed in the dip tube or a movable part, whereby movement in translation of the dip tube or said movable part is converted into movement in rotation of said ring, said ring including at least a portion that is toothed and suitable for co-operating with a toothed portion of the movable gouge.

27. An auger according to claim 23, wherein said additional hollow tubular member is a tube segment mounted to move in translation in the hollow core of the auger, at the bottom end of the hollow core.

28. An auger according to claim 27, wherein said tube segment is mounted to move in translation inside the core of the auger, and wherein said control means cause the gouge to be displaced from said retracted position to said active position in response to the displacement of the tube segment.

29. An auger according to claim 28, wherein said gouge is mounted to pivot about an axis substantially parallel to the longitudinal axis of the core, and wherein the control means comprise a ring mounted to turn about the tube segment and prevent it from moving in translation relative to the core of the auger, said ring being secured to a control finger suitable for co-operating with a helical slot formed in said movable tube segment whereby movement in translation of the tube segment is converted into movement in rotation of said ring, said ring including at least a portion that is toothed, suitable for co-operating with a toothed portion of the movable gouge.

30. An auger according to claim 28, wherein said gouge is mounted to pivot about an axis substantially parallel to the longitudinal axis of the core, and wherein the control means comprise a set-back portion formed in an outside face of the tube segment over a fraction of a periphery of the tube segment, and two pushers slidably mounted in the core of the auger, each pusher having a first end in contact with the outer face of the tube segment and a second end in contact with said movable gouge, whereby the tube segment turning relative to the core of the auger causes said pushers to be displaced so as to cause the movable gouge to pivot in one direction or the another.

31. An auger according to claim 23, wherein the core of said auger comprises a top portion and the bottom portion that is movable in translation relative to said top portion over a predetermined length, said gouge being mounted on said bottom portion, wherein said additional hollow tubular member comprises a tubular part secured to the bottom end of the top portion of said core and penetrating inside said bottom portion of the hollow core, and wherein said control means are mounted on said tubular part in such a manner that displacement of said bottom portion of the core in translation relative to said tubular part causes the gouge to be displaced from said retracted position to said active position.

32. An auger according to claim 31, further including means for constraining said top and bottom portions of the core relative to each other in rotation.

33. An auger according to claim 32, wherein said gouge is movable in translation along a radial direction.

* * * * *

UNITED STATES PATENT AND TRADEMARK OFFICE

CERTIFICATE OF CORRECTION

PATENT NO. : 7,591,329 B2
APPLICATION NO. : 11/493706
DATED : September 22, 2009
INVENTOR(S) : Perpezat et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 188 days.

Signed and Sealed this

Twenty-first Day of September, 2010

David J. Kappos

David J. Kappos
*Director of the United States Patent and Trademark Office*